US006719063B2

(12) United States Patent
Adams et al.

(10) Patent No.: US 6,719,063 B2
(45) Date of Patent: Apr. 13, 2004

(54) DOWNHOLE GRIPPING TOOL AND METHOD

(75) Inventors: Richard W. Adams, Houston, TX (US); Ronnie D. Arnold, Missouri City, TX (US)

(73) Assignee: TIW Corporation, Houston, TX (US)

( * ) Notice: Subject to any disclaimer, the term of this patent is extended or adjusted under 35 U.S.C. 154(b) by 0 days.

(21) Appl. No.: 10/106,312

(22) Filed: Mar. 26, 2002

(65) Prior Publication Data

US 2003/0183396 A1 Oct. 2, 2003

(51) Int. Cl.[7] ..... E21B 23/00
(52) U.S. Cl. ..... 166/382; 166/216; 166/217
(58) Field of Search ..... 166/216, 217, 166/382, 387, 118, 138, 139, 208

(56) References Cited

U.S. PATENT DOCUMENTS 3,241,616 A * 3/1966 Cox ..... 166/216
4,811,785 A 3/1989 Weber
4,830,103 A 5/1989 Blackwell et al.
5,311,941 A * 5/1994 Baugh ..... 166/216
6,119,774 A * 9/2000 Doane et al. ..... 166/216

* cited by examiner

*Primary Examiner*—David Bagnell
*Assistant Examiner*—Matthew J Smith
(74) *Attorney, Agent, or Firm*—Loren G. Helmreich; Browning Bushman, P.C.

(57) ABSTRACT

A gripping tool 10 may be positioned in a well on a running string RS to at least temporarily secure the gripping tool to a borehole wall. The gripping tool includes a drag member 72, a plurality of slips 40, 48, and a cone member 30, 46. A slip setting mechanism 88 is provided for securing the slips in the radially inward position when the slip setting mechanism is run-in the well. At least one ramp moves the slip setting mechanism to a released position upon rotation of the running string in a first direction. A ratchet member rotationally releases the running string from the slip setting mechanism when the running string is rotated in an opposing direction. The tool may be set, released by pickup and returned to the run-in position, then reset without returning the tool to the surface.

19 Claims, 3 Drawing Sheets

DOWNHOLE GRIPPING TOOL AND METHOD

FIELD OF THE INVENTION

The present invention relates to downhole gripping tools commonly used in the hydrocarbon recovery industry to anchor a tool within a downhole tubular. In particular, the present invention relates to improved method for releasing the slip setting mechanism upon rotation of the work string in one direction, while also insuring that the slip setting mechanism is not damaged in the event of rotation of the running string or work string in the opposite direction.

BACKGROUND OF THE INVENTION

Downhole gripping tools, such as liner hangers, hook wall packers and anchors, commonly include circumferentially spaced slips which are moved radially outward into biting engagement with the interior diameter of the downhole tubular or the borehole wall upon axial movement of the tapered cone relative to the slips. The desired axial movement may be achieved with a hydraulic setting mechanism, but in many applications the set down weight to the running string is sufficient to achieve the desired axial movement and bring the slips into gripping engagement, thereby anchoring the gripping tool within the well. In a subsequent application of hydraulic pressure or through vertical manipulation of the running string, these slips may be disengaged, thereby releasing the anchored gripping tool from its position in the well. A liner hanger, packer, or other gripping tool may thus be run in the well on a work string, positioned at a desired location within the downhole tubular or open well bore, and then set to at least temporarily affix the gripping tool to the downhole tubular within the well bore. A release mechanism is commonly provided to release the running string from the set downhole gripping tool, so that the running string may be returned to the surface and, if desired, another tool or tubular passed through the bore of the set gripping tool.

Many mechanically set gripping tools have utilized two successive or sequential rotational movements in opposite directions to release the slips and thereafter bring the gripping tool into fixed engagement within the well, and to release the set gripping tool from the running string. One rotation may be used to release the slip setting mechanism, and another rotational movement may be used to release the running string from the set downhole tool. Left-hand rotation of the work string and thus the running tool may be used to initiate the release of the gripping tool to be moved to the set position, and then right-hand rotation of the work string and the running tool may be used to effect the release of the gripping tool so that running string may be returned to the surface. Any time left-hand rotation is applied to a right-hand threaded work string, there is the danger of unthreading one of the multiple joints, rather than the desired transmission of the rotational force through the multiple joints to the running tool. The release of the slip setting mechanism and the release of the tool from the work string may be in the same rotational direction, which preferably is the same as the threaded connections of the work string. U.S. Pat. No. 4,709,758 discloses a packer which is released by rotation of the running string to position a J-pin in an axially elongated portion of a J-slot, followed by upward movement of the running string to compress the packing element to form a seal with the casing well and expand the slips.

Reliability of setting operation is paramount, since the consequences of a failed tool may cost hundreds of thousands of dollars. In addition, it is very important that the cone not move prematurely with respect to the slips, or that the slips not move outward before cone movement, which may cause the gripping tool to prematurely set in the well, or may allow teeth on the slips to get hung up in the well or damage a downhole sealing surface.

Slips on downhole tools are most commonly released from their run-in position and allowed to move to the engaged or set position by vertical manipulation of running string and thus vertical movement of the cone with respect to the slips. The cone may be secured to a mandrel which is threadably connected to the work string. The slips may be held stationary by a bowed slat stabilizer or other drag mechanism which engages the inner wall of the casing or well bore and resists axial movement with the work string. In many applications, a radially projecting pin secured to the mandrel fits within a J-slot in the outertool body to control movement of the slips from the run-in position to the released position and then to the set position by vertical manipulation of the work string. U.S. Pat. No. 6,241,017 discloses a packer which uses tension in a wireline to shear a connection. A collet is detachably secured to a threaded profile. Axial movement of the running string applies an axial force to move the slips into biting engagement with the casing.

U.S. Pat. No. 4,548,264 discloses a high temperature packer which is set by rotating the running string clockwise or to the right from the surface. Sufficient rotational torque shears pins that allows shoulders to contact respective abutments. The torque transmitting features allow the setting force to be applied by simply rotating the running string to the right. No J-slot mechanism is utilized. Torque is transmitted through sliding dogs causing the setting nut to move downward with respect to a lower cone. U.S. Pat. No. 4,903,777 discloses a dual seal packer which is set by rotating the running string to the right with tension on the string. When rotating the string to the right, left-hand threads on the mandrel work up the internally threaded surface of a running ring, thereby moving the mandrel upward with respect to the cage. Right-hand threads on the ratchet engage an internally threaded surface of the setting ring, and contact of the expander ring with the tapered surface of the slips causes the teeth to engage the casing.

U.S. Pat. No. 4,388,971 discloses a tubing hanger wherein a plurality of spring biased dogs carried by the running tool snap into engagement with cooperating internal grooves formed in the bore of the tubular body of the tool. A radial pin moves upward into the top end of an L-shaped slot so that the work string may be rotated to the right, causing the radial pin to move out of the slot, so that the cone may be moved downward relative to the slips to move the slips outward. The tool may be released by unthreading a connecting nut from the internal threads on the upper body section of the tubing hanger. U.S. Pat. No. 4,598,744 discloses a setting tool with retractable collet fingers. When the tool is made up at the surface, a setting nut is in engagement with a setting sleeve extension by right-hand connecting threads. A mandrel is biased by a coil spring, and a shear pin keeps the mandrel with the latch ring when in the run-in position.

A significant deficiency with prior art tools is the difficulty associated with reliably and not prematurely releasing the slips due to vertical manipulation of the running string (commonly coupled with some limited rotation of the running string), particularly when vertical manipulation is used to set the slips once the slip setting mechanism is released. A tool promoted by Baker Hughes, Inc. under Product No.

292-40/292-65 is believed to be intended to release the slip setting mechanism by merely rotation of the running string with no vertical movement, with vertical movement then being used to subsequently set the slips by moving the cone relative to the slips after the slip setting mechanism is released. A rotatable version of the tool is offered by Baker Hughes under Product No. 292-41/292-66.

While downhole tools which are secured in a well have been released from a run-in position to the released position by rotation of the work string, most mechanisms for accomplishing this release are very complex. Complex mechanisms not only reduce the reliability and increase the cost of the tools, but conventionally downhole tools such as liner hangers have a sizable bore, so that the annular spacing between the OD of a casing and the ID of the liner hanger may be very limited. Other tools do not use set-down weight to move the slips from the released position to the set position, and instead use less reliable or more costly techniques to set the tool in the well.

The disadvantages of the prior art are overcome by the present invention, and an improved gripping tool is hereinafter disclosed which utilizes a reliable mechanism to move the slip setting mechanism from the run-in position to the released position, so that set down weight thereafter may be easily applied to set the gripping tool in the well. Opposing rotation of the work string does not damage the tool due to a rachet mechanism provided in the tool according to the present invention.

SUMMARY OF THE INVENTION

The gripping tool according to the present invention may be moved from the run-in position to the released position for setting the slips by merely rotating the running string to the desired direction, e.g., to the right. Once rotated to release the slip setting mechanism, set down weight may then be used to set the slips by moving the cone axially with respect to the slips. Most importantly, a ratchet mechanism is provided so that any reverse rotation of the running string, which may be due to backlash or for other reasons, does not damage the slip setting mechanism on any other part of the downhole gripping tool.

It is an object of the present invention to provide a gripping tool for lowering within a well on a running string, with a gripping tool including a drag member, a plurality of slips, a slip setting mechanism, and a cone member axially moveable relative to the slips to move the slips radially outward to a set position for gripping the borehole wall. At least one ramp is secured to one of the running string or the outer tool body, and moves the slip setting mechanism to a released position when the running string is rotated in a first direction. A ratchet member allows rotation of the slip setting mechanism with respect to the at least one ramp when the running string is rotated in the first direction, and rotationally releases the slip setting mechanism from the running string when the running string is rotated in an opposing second direction.

A related feature of the present invention is a method of using a gripping tool as discussed above. After positioning the tool at a desired depth within a well, the running string may be rotated to move the slip setting mechanism to the released position. If the tubing string rotates in the opposing direction, a ratchet member rotationally releases the slip setting mechanism from the running string.

It is a feature of the present invention that the circumferentially spaced slips may each be provided in a pocket in the outer tool body, thus substantially reducing the likelihood of the slip prematurely moving radially outward from the run-in position. A related feature of the invention is that the slips need not move relative to the outer tool body during the process of moving to the slip setting mechanism from the run-in position to the released position.

A significant feature of the present invention is that a downhole gripping tool may be set in a well, with the tool including circumferentially spaced slips which are moved from the run-in position to a released position for setting the slips due to only rotation of the work string. Reliability of the tool is significantly increased by providing a ratchet mechanism which prevents rotation of the running string in the opposite direction from damaging the slip setting mechanism. The ratchet mechanism is provided between the slip setting mechanism and one of the outer tool body and the inner mandrel.

Another feature of the invention is that the outer tool body may be a cage which axially and circumferentially fixes the slips with respect to the cage. The slip setting mechanism may include axial extending collet fingers which engage a stop surface on the mandrel or the outer tool body. The collet fingers may have a negative angle run-in surface for engagement with a mating negative angle stop surface.

A further feature of the invention is that the ratchet mechanism may include a plurality of torque transmitting surfaces each for engagement with one of the outer tool body and the inner mandrel or barrel when the running string is rotated in the first direction, and a plurality of torque releasing surfaces each for engagement with one of the outer tool body and the inner mandrel when the running tool is rotated in the opposing second direction.

Yet another feature of the invention is that a radially outer surface secured to one of the mandrel and the outer tool body may be provided for maintaining the slip setting mechanism radially in the released position in response to rotation of the work string in a first direction, and an overhang surface radially spaced from the ramp prevents the slip setting mechanism from returning to the run-in position during rotation of the running string in the first direction.

Another feature of the invention is that the downhole tool may utilize vertical manipulation of the work string to release the slips from the set position back to the run-in position.

Another feature of the invention is that the downhole tool may be reliably set, then may be released and subsequently re-set without returning the tool to the surface. Damage to the collet fingers is prevented when the running string is rotated in the opposite direction from that used to release the slip setting mechanism.

An advantage of the invention is that the downhole gripping tool may be manufactured at a relatively low cost, and is highly reliable. Another advantage of the invention is that the gripping tool may be used as a liner hanger, a packer, or an anchor in a well.

Yet another advantage of the invention is that technique for operating the gripping tool is relatively simple, thereby increasing reliability. Even if the gripping tool were to be prematurely set while positioning the tool in a well, the gripping tool may be easily unset and returned to the run-in position.

These and further objects, features, and advantages of the present invention will become apparent in the following detailed description, when reference is made in the figures in the accompanying drawings.

BRIEF DESCRIPTION OF PREFERRED EMBODIMENTS

Figure 1A:
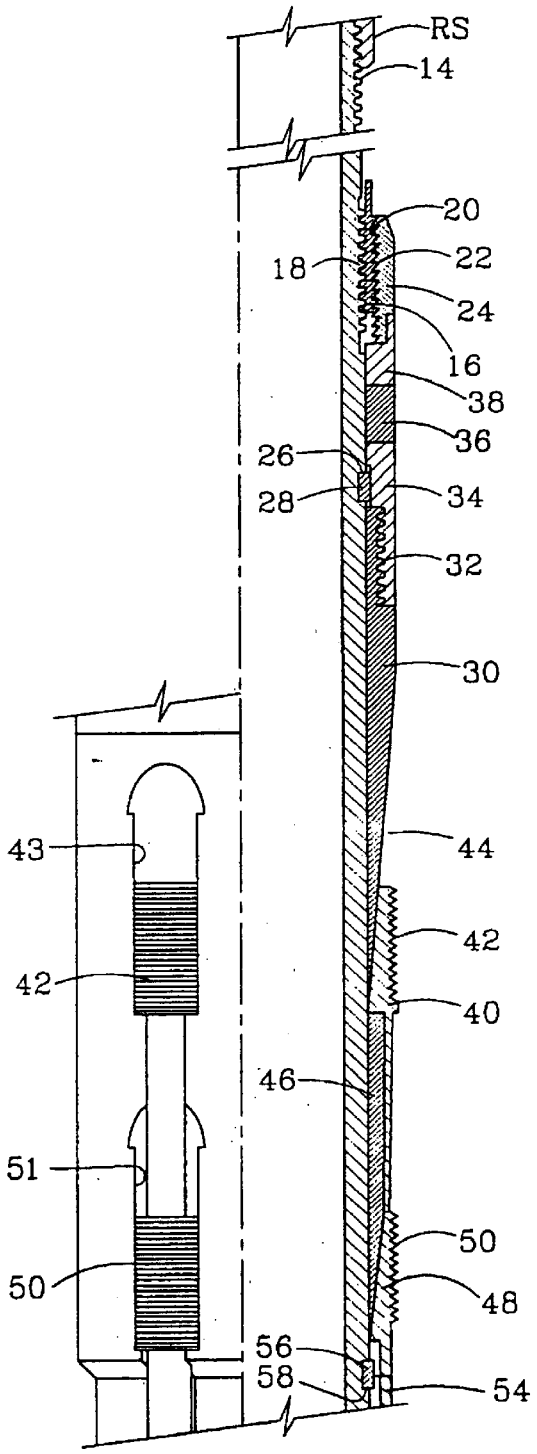
FIGS. 1A–1C are half-sectional views of a gripping tool according to the present invention.
Figure 1B:
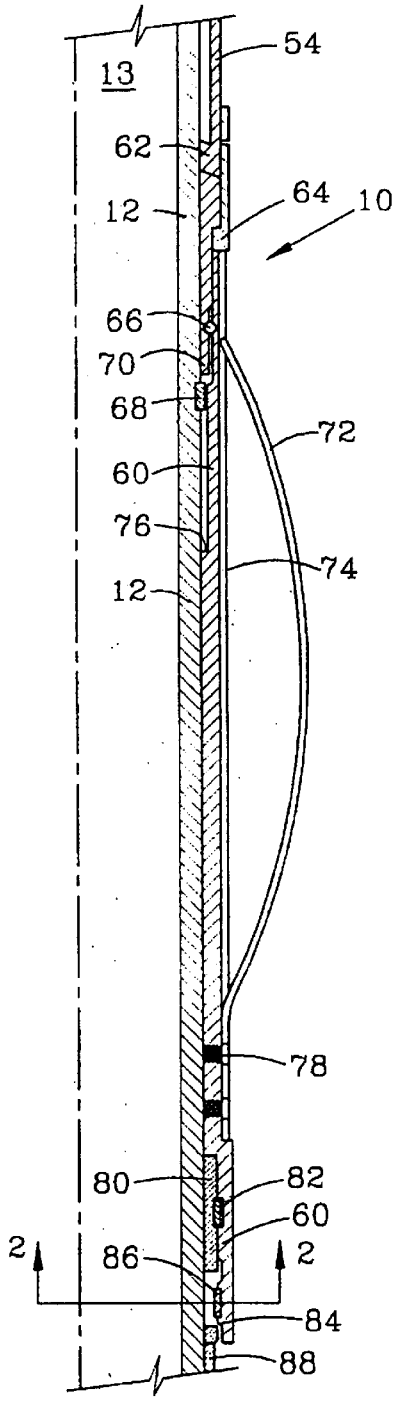
Figure 1C:
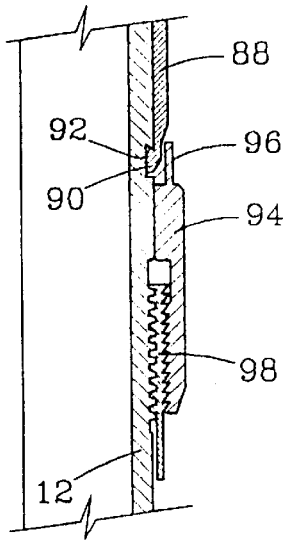

FIGS. 1A, 1B, 1C together illustrate the gripping tool 10 according to the present invention for lowering within a well on running string RS to position the gripping tool downhole and either temporarily or permanently secure the gripping tool to the borehole wall. Those skilled in the art will appreciate that the borehole wall may be the formation wall in an open hole, and commonly will be a downhole tubular, such as the casing, within a well. For the embodiment shown in FIG. 1, the gripping tool is a liner hanger, although the concepts of the present invention may also be applied to packers and anchors which have similar slips for gripping engagement with the borehole.

The tool 10 includes an inner mandrel or barrel 12 having a central flow path 13, and an outer tool body 60, which is preferably a cage, for axially fixing the slips with respect to the cage. The upper end of the mandrel includes conventional threads 14 for threaded engagement with the running string RS, and conventionally threads 14 may be cut to a customer's specification. Thread 18 on the mandrel is in threaded engagement with upper lock ring 20, and thread 16 on the lock ring engages threads 22 on the upper lock nut. A C-ring 28 fits within an annular groove 26 on the mandrel 12, and acts as a stop to prohibit axial movement of retainer 34. Annular nut cover 38 is provided below the lock nut 24, and annular spacer 36 is positioned axially between the nut cover 38 and the retainer 34. The lower end of the retainer 34 includes threads 32 for supporting a cone 30, which has a cone ramp surface 44. A slip 40 includes slip teeth 42 and, as explained subsequently, the cone moves axially relative to the slips to move the slips radially outward to set the liner hanger. A slip arm is provided at the lower end of the slip 40, and with cone member 46 forms another cone surface for moving slips 48 with slip teeth 50 radially outward during setting of the gripping tool. The lower cone 46 is axially fixed to the mandrel 12 by C-ring 56, which fits within groove 58 in the mandrel. Lower slip arm 54 extends downward to bushing 62, as shown in FIG. 1B. The cone members may thus move axially with the running string relative to the slips to move the slips radially outward to a set position for gripping the borehole wall.

The gripping tool according to the present invention includes a drag member, which may be a drag block or other member which frictionally engages the side wall of the borehole to resist movement with the running string. As shown in FIG. 1B, the drag member includes a plurality of circumferentially spaced bow springs 72 which are held in position by lock screws 78 on an outer tool body or cage 60. A mill slot 74 is provided in the cage 60 for the bow springs 72. A C-ring 68 provided in a groove within the mandrel 12 provides a stop to keep the slips from coming out of the pockets if set in a large hole. Ring 68 will stop on shoulder 76 on cage 60. Ball bearings 66 spaced between the sleeve 62 and the cage 60 facilitate rotation between these components. Sleeve 64 surrounds the bushing 62 to capture the slip arm 54.

Figure 2:
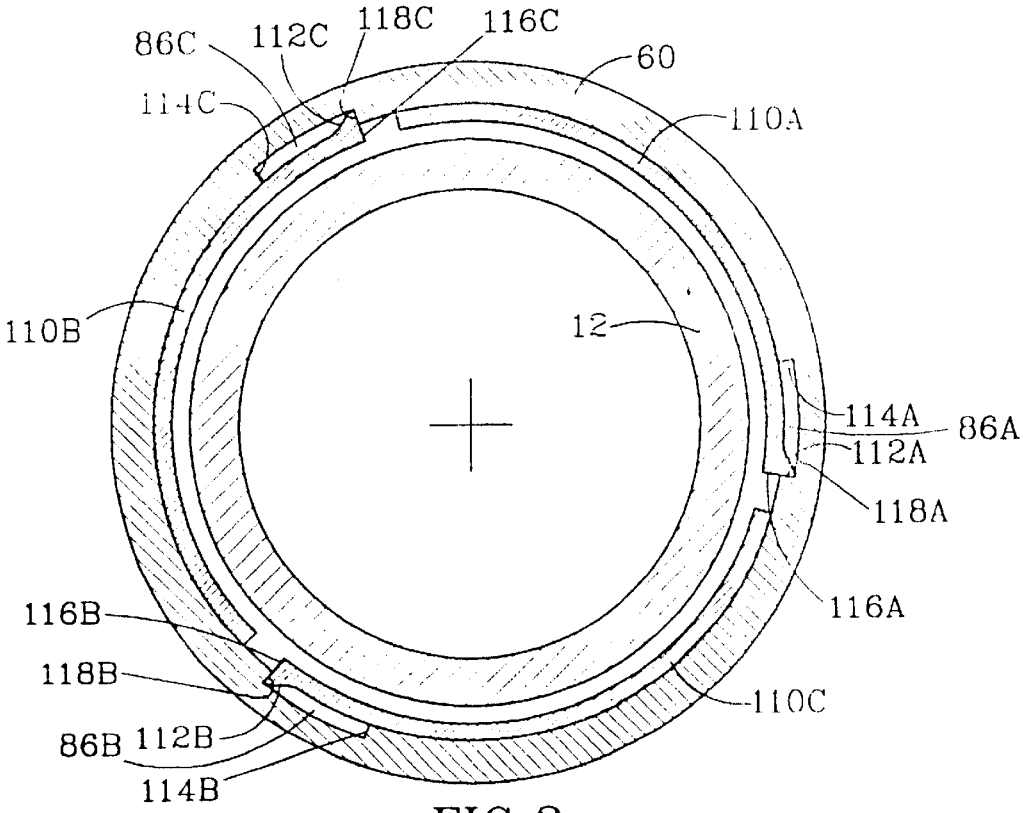
FIG. 2 is a cross-section of the tool taken along the lines 2—2 in FIG. 1B.

Collet mechanism 80 is provided below the drag member 72, and is retained on the outer tool body or cage 60 by keeper ring 82. Collet mechanism 80 includes an upper ring and three circumferentially extending collet fingers 110 as shown in FIG. 2, which form ratchet fingers 110A, 110B, and 110C which each cooperate with a groove 86 in the cage 60 to allow racheting during left-hand rotation of the running string. The collet mechanism also includes four axially extending collet fingers 88 extending downward from the lower end of the collet fingers 110 and, as shown in FIG. 1C, each collet finger has a lower head 90 which fits within a locking groove 92 provided in the inner mandrel or barrel 12. The upper collet ring, collet fingers 110 and collet fingers 88 may be formed as a unitary member, or may be separately forms and structurally interconnected. A lower lock nut 94 is threaded to a lower lock ring 98, which in turn is threaded to the barrel 12.

The collet fingers 88 act as a slip setting mechanism to secure the running string RS to the slips when the slip setting mechanism is in a run-in position, as shown in FIG. 1C. In that position, the collet heads 90 are within the locking groove 92, and the release shoulder 96 extending upward from the lower lock nut 94 is radially outward of the heads 90.

Figure 3:
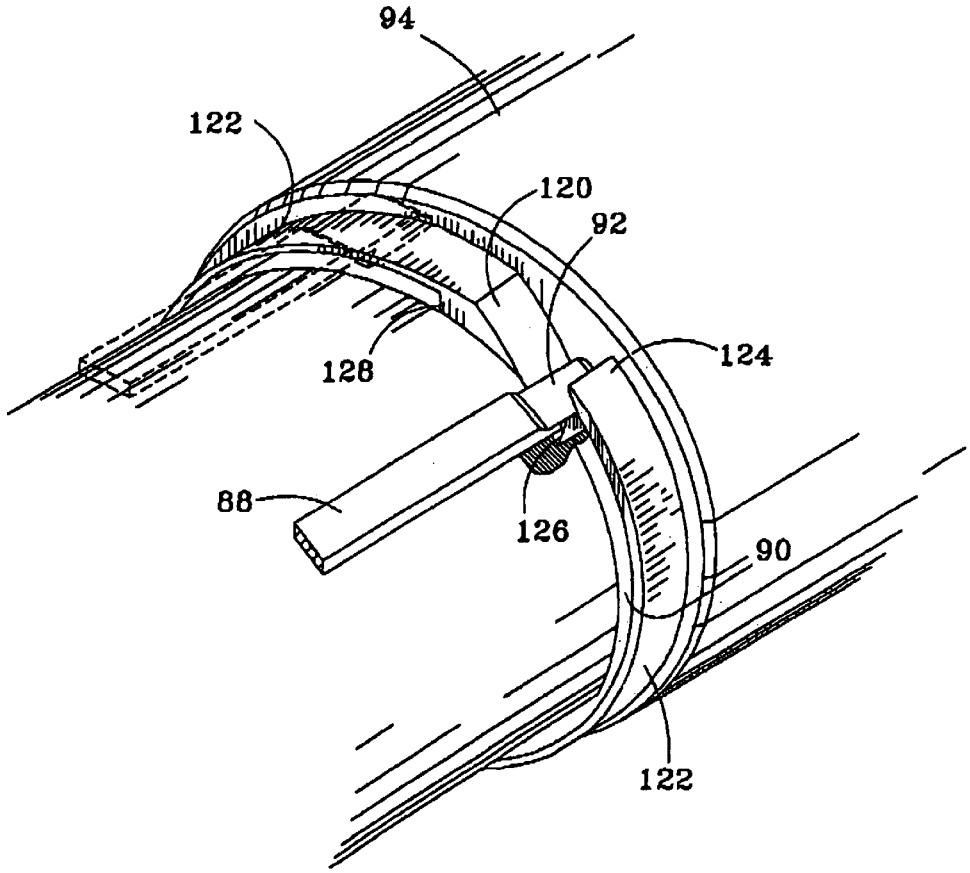
FIG. 3 is a pictorial view of a collet finger and the ramp used to move the collet mechanism from the run-in position to the released position. The collet finger in solid lines in FIG. 3 is in the run-in position as shown in FIG. 1C, and upon rotation of the work string, the collet finger moves up the ramp to the released position, as shown in dashed lines in FIG. 3.

FIG. 3 discloses a ramp 120 which in the depicted embodiment is secured to the inner mandrel or barrel 12. A radially outer generally cylindrical surface 122 secured to the ramp 120 maintains the slip setting mechanism 88 radially outward of the run-in position in response to rotation of the work string in a first, right-hand direction. An overhang surface 124 is provided radially outward of a radially innermost portion of the ramp 120 for preventing the slip setting mechanism from returning to the run-in position during rotation of the running string in the first direction. During rotation of the running string, collet finger head 92 moves radially outward riding up the ramp 120 during right-hand rotation of the running string. Actually, for the preferred embodiment, the drag member holds the slip setting mechanism stationary, and the ramp 120 rotates with the running string. It is the relative movement between the slip setting mechanism and the ramp which is essential; either one can be rotated while the other is held stationary by the outer tool body. In a preferred embodiment, four axially extending collet fingers 88 and three circumferentially extending collet fingers 110 may be provided equally spaced about the tool, although any desired number of collet fingers may be used. One complete rotation of the running string will thus move each of the collet fingers from the run-in position, as shown for the finger 88 in solid lines in FIG. 3, to the released position, as shown for finger 88 in dashed lines in FIG. 3. More than one rotation of the running string will not cause any change, since the collet fingers 88 will continue to rotate on top of the surface 122, and when dropping off the overhang 124 will fall onto the middle portion of the ramp 120 and thus be prevented from falling back into the locking groove 92. Also, each of the collet fingers 88 has a negative angle run-in catch surface 96 for engagement with a mating negative angle stop surface on the mandrel 12 to more reliably secure the slip setting mechanism in position when in the run-in position. The term "negative angle" as used herein is intended to mean any angle which provides a force which resists movement of the collet fingers to the released position in response to increased axial forces on the collet fingers.

FIG. 2 depicts more clearly the ratchet mechanism according to the present invention for rotatably securing the slip setting mechanism with the outer tool body or cage 60 when the running string is rotated in the right-hand direction, and for rotationally releasing the slip setting mechanism from the cage 60 when the running string is rotated in the left-hand direction. More particularly, the ratchet member includes circumferentially extending ratchet fingers 110 each having a deflecting ramp or torque releasing surface 112 for engagement with the deflecting shoulder 114 provided on the cage 60. Each ratchet finger 110 also includes a torque transmitting surface 116 for engagement with the mating surface 118 on the outer tool body to rotatably secure the slip setting mechanism to the cage 60 when the running string is rotated to the right. The torque releasing surfaces thus rotationally release the ratchet fingers from the cage 60 if the running string were rotated to the left, either intentionally or due to an undesired backlash of the running string. The purpose of the ratchet mechanism as shown in FIG. 2 is to prevent damage to the downhole tool, including damage to the fingers 88, which would undesirably result when a ratchet finger 88 would otherwise engage the surface 128, as shown in FIG. 3, during opposite rotation of the running string, thereby bending or damaging the fingers. In a preferred design, a plurality of torque transmitting surfaces each on a finger 110 are provided for engagement with the outer tool body when the running string is rotated in the first direction, and a similar plurality of torque releasing surfaces are provided on the same ratchet fingers for engagement with the outer tool body when running string is rotated in the second direction. A radially outward protrusion on each of the ratchet fingers 110 thus normally, i.e., when the slip setting mechanism in the run-in position, rests within a groove 86 provided in the outer tool body.

A significant advantage of the gripping tool according to the present invention is that the slips may be provided within well protected pockets in the cones. As shown in FIG. 1A, each slip 42, 50 is provided in a respective pocket 43, 51 within a cone member, thereby allowing the stationary slip to move outward as the cones move down the slips. The stationary slips thus stay in the slip pockets as the cones move downward. Since the running string must be rotated in order for the slip setting mechanism to move from the run-in position to the set position, the work string may be set down or picked up at various times when running the tool in the well without risking the chance of the tool inadvertently setting or the slips moving prematurely outward to "hang up" the tool or damage the downhole sealing surface.

Those skilled in the art will appreciate that the gripping tool may be released from the set position by picking up the running string, which will release the slips and return the slip setting mechanism to the run-in position, with the fingers 88 again being latched in the groove 92, as shown in FIG. 1C. Once reliably set in the well, the tool may be released to return the slip setting mechanism to the run-in position, then the tool resets and later unset, without returning the gripping tool to the surface. If prematurely set due to an inadvertent rotation of the running string, the tool may be easily unset and relocated in the well.

According to the method of the present invention, a gripping tool is provided as disclosed herein and is positioned in a desired location within a well. To release the slip setting mechanism from the run-in position, the running string is rotated to the right, moving the fingers 88 radially outward to a released position. Set down weight may then be used to move the cone relative to the slips to set the gripping tool. In the event that the tool were rotated in the opposite direction, the ratchet mechanism releases the slip setting assembly as discussed above. The tool may be reliably set, and may be released or unset by simply picking up on the running string, thereby returning the slip setting mechanism to the run-in position. The gripping tool may be subsequently re-set and released several times in the well without returning the tool to the surface.

For the embodiment as shown in the figures, the ramp member is fixed to the inner mandrel or barrel 12, and the slip setting mechanism is rotationally secured to the outer tool body and thus the drag member. This design is preferred for simplicity of the gripping tool. In an alternate embodiment, the ramp member may be fixed to the outer tool body, and the slip setting mechanism then rotationally secured to the mandrel. The ratchet member for this alternate embodiment would then be provided between the mandrel and the slip setting mechanism for rotating the slip setting mechanism with the running string when the running string is rotated in a first direction, and for rotationally releasing the slip setting mechanism from the running string when rotating in the opposing direction. If desired, more than one ramp may be provided in either embodiment.

The work string may be rotated to the right to move the slips from the run-in position to a released position, then the subsequent axial movement of the cone with respect to the slips will set the downhole gripping tool. Alternatively, the tool could be constructed so that the slip release mechanism moved along the ramp from the run-in position to the release position by rotating the running string to the left, in which case the ratchet mechanism may rotatably disengage the running string from the slip setting mechanism when rotated to the right or clock-wise. Since left-hand rotation of a running string above a predetermined torque level is not desired since the running string could unthread, this latter embodiment may be used for a tool which could be released by left-hand rotation under very low torque, with right-hand rotation being taken up by the ratchet mechanism. The downhole gripping tool may be provided which releases the slips upon either the right-hand or left-hand rotation of the work string, as desired.

The gripping tool includes circumferentially spaced slips which cooperate with a conventional cone member. If desired, both upper and lower slips and corresponding upper and lower cone members may be provided. When the gripping tool mechanism of the present invention is used as a packer, a packer element will be provided for sealing engagement with the interior walls or downhole tubular of the well bore. When used as a liner hanger, a tapered roller bearing assembly may be provided for allowing the liner to be rotated once the liner hanger is in the set position, e.g., while cementing the liner in place. The slip need not be pocketed within a cone, and may instead merely be secured to the cage while being radially outward of a cone.

Various types of drag members, including bow strings and drag blocks, may be used to engage the interior wall of the downhole tubular or the well bore and create sufficient friction to allow movement of the work string with respect to the drag member during vertical movement of the cone with respect to the slips.

It may be appreciated that changes in the details of the illustrated embodiments and the method disclosed herein are possible without departing from the spirit of the invention. While preferred and alternate embodiments of the invention have been described, it is apparent that further modifications and adaptations of the preferred and alternative embodiments may occur to those skilled in the art. It is to be understood that such modifications and adaptations are within the spirit and scope of the invention, and set forth in the following claims.

What is claimed is:

1. A gripping tool for lowering within a well on a running string to position the gripping tool downhole in the well and at least temporarily secure the gripping tool to a borehole wall, such as formed by downhole tubular, the gripping tool comprising:

a drag member carried by an outer tool body axially moveable relative to an inner mandrel secured to the running string, the drag member engaging the borehole wall to resist movement with the running string;

a plurality of circumferentially spaced slips for gripping the borehole wall;

a slip setting mechanism axially securing the running string to the slips when the setting mechanism is in a run-in position, wherein the slip setting mechanism includes a collet mechanism having axially extending collet fingers for engagement with a mating stop surface secured to one of the mandrel and the outer tool body;

a con member axially moveable with the running string relative to the slips to move the slips radially outward to a set position for gripping the borehole wall;

at least one ramp secured to one of the running string and the outer tool body for moving the slip setting mechanism to a released position when the running string is rotated in a first direction; and a ratchet member for rotating the slip setting mechanism with respect to the at least one ramp when the running string is rotated in the first direction, and for rotationally releasing the slip setting mechanism from rotation with the at least one ramp when the running string is rotated in an opposing second direction.

2. A gripping tool as defined in claim 1, wherein the outer tool body is a cage for axially fixing the slips with respect to the cage, and the slip setting mechanism includes axially extending collet fingers which each engage a stop surface secured to one of the mandrel secured to the running string and the outer tool body.

3. A gripping tool as defined in claim 1, wherein the cone member includes corresponding pockets each for circumferentially securing one of the plurality of slips with respect to the cone member.

4. A gripping tool as defined in claim 1, wherein:

the slip setting mechanism includes axially extending first collet fingers which engage a stop surface on the mandrel secured to the running string; and the ratchet member includes circumferentially extending second collet fingers each having a torque transmitting surface for engagement with the outer tool body when the running string is rotated in the first direction, and a torque releasing surface on each second collet finger for engagement with the outer tool body when the running string is rotated in the opposing second direction.

5. The gripping tool as defined in claim 4, wherein a radially outward protrusion on each of the second collet fingers rests within a groove provided in the outer tool body when the tool is in the run-in position, and the torque transmitting surface engages one side of the groove when the tubing string is rotated in the first direction, and the torque releasing surface engages an opposing side of the groove when the running tool is rotated in the opposing second direction.

6. A gripping tool as defined in claim 1, wherein the ratchet mechanism comprises:

a plurality of torque transmitting surfaces each for engagement with one of the inner mandrel and the outer tool body when the running string is rotated in the first direction; and a plurality of torque releasing surfaces each for engagement with the other of the inner mandrel and the outer tool body when the running string is rotated in the opposing second direction.

7. A gripping tool as defined in claim 1, further comprising:

a radially outer surface secured to the ramp for maintaining the slip setting mechanism radially from the run-in position in response to rotation of the running string in the first direction; and an overhang surface spaced radially from the at least one ramp for preventing the slip setting mechanism from returning to the run-in position during rotation of the running string in the first direction.

8. A gripping tool as defined in claim 1, wherein the gripping tool is released by picking up on the running string, such that the picking up the running string returns the slip setting mechanism to the run-in position.

9. A gripping tool as defined in claim 1, wherein the gripping tool, once set in the well, may be released and subsequently reset such that the slip setting mechanism returns to the run-in position without returning the gripping tool to the surface.

10. A gripping tool for lowering within a well on a running string to position the gripping tool downhole in the well and at least temporarily secure the gripping tool to a borehole wall, such as formed by downhole tubular, the gripping tool comprising:

a drag member carried by an outer tool body axially moveable relative to an inner mandrel secured to the running string, the drag member engaging the borehole wall to resist movement with the running string;

a plurality of circumferentially spaced slips for gripping the borehole wall;

a collet mechanism including axially extending first collet fingers which engage a stop surface on the mandrel secured to the running string for axially securing the running string to the slips when the collet mechanism is in a run-in position;

a cone member including a pocket for receiving one of the plurality of slips and axially moveable with the running string relative to the slips to move the slips radially outward to a set position for gripping the borehole wall;

at least one ramp secured to one of the running string and the outer tool body for moving the slip setting mechanism to a released position when the running string is rotated in a first direction; and a ratchet member including circumferentially extending second collet fingers each having a torque transmitting surface for engagement with the outer tool body when the running string is rotated in the first direction, and a torque releasing surface on each second collet finger for engagement with the outer tool body when the running string is rotated in the opposing second direction.

11. A gripping tool as defined in claim 10, wherein the first collet fingers have a negative angle run-in catch surface for engagement with a mating negative angle stop surface on the mandrel secured to the running string.

12. A gripping tool as defined in claim 11, wherein a radially outward protrusion on each of the second collet fingers rests within a groove provided in the outer tool body when the tool is in the run-in position, and the torque transmitting surface engages one side of the groove when the tubing string is rotated in the first direction, and the torque releasing surface engages an opposing side of the groove when the running tool is rotated in the opposing direction.

13. A gripping tool as defined in claim 10, further comprising:

a radially outer surface secured to the ramp for maintaining the slip setting mechanism radially outward of the run-in position in response to rotation of the running string in the first direction; and an overhang surface radially outward of a radially innermost portion of the at least one ramp for preventing the slip setting mechanism from returning to the run-in position during rotation of the running string in the first direction.

14. A gripping tool as defined in claim 10, wherein:

the gripping tool is released by picking up on the running string, such that the picking up the running string returns the collet mechanism to the run-in position; and the gripping tool, once set in the well, may be released and subsequently reset such that the collet mechanism returns to the run-in position without returning the gripping tool to the surface.

15. A method of setting a gripping tool within a well on a running string to at least temporarily secure the gripping tool to a borehole wall, such as formed by down hole tubular, the method comprising:

providing a drag member on an outer tool body axially moveable relative to an inner mandrel secured to the running string, the drag member engaging the borehole wall to resist movement with the running string;

providing a plurality of circumferentially spaced slips forgripping the borehole wall;

providing a slip setting mechanism to axially secure the running string to the slips when the slip setting mechanism is in a run-in position;

securing at least one ramp to one of the inner mandrel secured to the running string and the outer tool body for moving the slip setting mechanism to a released position when the running string is rotated in a first direction;

while the gripping tool is in the well, rotating the running string to move the slip setting mechanism along the at least one ramp from the run-in position to the released position; thereafter moving a cone member axially with the running string relative to the slips when the slip setting mechanism is in the released position to move the slips radially outward to set position for gripping the borehole wall; and providing a ratchet member for rotating the slip setting mechanism with the running string when the running string is rotated in the first direction, and for rotatably releasing the slip setting mechanism from the running string when the running string is rotated in an opposing second direction.

16. A method as defined in claim 15, wherein the slip setting mechanism includes a collet mechanism having axially extending collet fingers with a negative angle run-in catch surface for engagement with a mating negative angle stop surface secured to one of the mandrel secured to the running string and the outer tool body.

17. A method as defined in claim 15, wherein:

the slip setting mechanism includes axially extending first collet fingers which engage a stop surface secured to one of the mandrel secured to the running string and the outer tool body; and the ratchet member includes circumferentially extending second collet fingers each having a torque transmitting surface for engagement with one of the outer tool body and the mandrel when the running string is rotated in the first direction, and a torque releasing surface on each second collet finger for engagement with the other of the outer tool body and the mandrel when the running string is rotated in the opposing second direction.

18. A method tool as defined in claim 15, further comprising:

providing a radially outer surface secured to the ramp for maintaining the slip setting mechanism radially spaced from the run-in position in response to rotation of the running string in the first direction; and providing an overhang surface radially spaced from the at least one ramp for preventing the slip setting mechanism from returning to the run-in position during rotation of the running string in the first direction.

19. A method as defined in claim 15, wherein:

releasing the gripping tool by picking up on the running string, such that the picking up the running string returns the slip setting mechanism to the run-in position, and the gripping tool, once set in the well, may be released and subsequently reset such that the slip setting mechanism returns to the run-in position without returning the gripping tool to the surface.

* * * * *